United States Patent [19]

Melan et al.

[11] 4,210,087

[45] Jul. 1, 1980

[54] METHOD OF OPERATION FOR A REFUSE INCINERATING FURNACE

[76] Inventors: Corneille Melan, 43, bld. Ch. Simonis, Luxembourg; René Weiwers, 106, rue Mertens, Bettembourg, both of Luxembourg

[21] Appl. No.: 919,126

[22] Filed: Jun. 26, 1978

[30] Foreign Application Priority Data

Jul. 1, 1977 [LU] Luxembourg ..... 77677

[51] Int. Cl.[2] ..... F23G 5/00

[52] U.S. Cl. ..... 110/346; 110/256; 110/259; 110/165 R

[58] Field of Search ..... 110/346, 243, 256, 259, 110/165 R

[56] References Cited

U.S. PATENT DOCUMENTS

| | | | |
|---|---|---|---|
| 3,577,939 | 5/1971 | Muirhead | 110/165 |
| 3,592,151 | 7/1971 | Webber | 110/243 |
| 3,729,298 | 4/1973 | Anderson | 110/243 |
| 3,934,523 | 1/1976 | Bercynski et al. | 110/165 |
| 4,126,427 | 11/1978 | Eales | 110/165 |

*Primary Examiner*—Edward G. Favors

*Attorney, Agent, or Firm*—Christel, Bean & Linihan

[57] ABSTRACT

A method of operating a furnace for incinerating refuse, notably household refuse, commercial and industrial waste or rubbish, wherein the furnace is of the type comprising a charging zone, a drying zone, a pyrolysis zone, and a combustion and melting zone with at least one orifice for extracting volatile products from the drying zone, at least one orifice for extracting the melted material in the combustion and melting zone, and one or more tuyeres for injecting the combustion gases under pressure into the combustion and melting zone, by which the combustion gases under pressure are injected into a volume of liquid or molten slag at the level of the combustion and melting zone so that the energy liberated by the injection of the gases under pressure is diminished and controlled.

5 Claims, 1 Drawing Figure

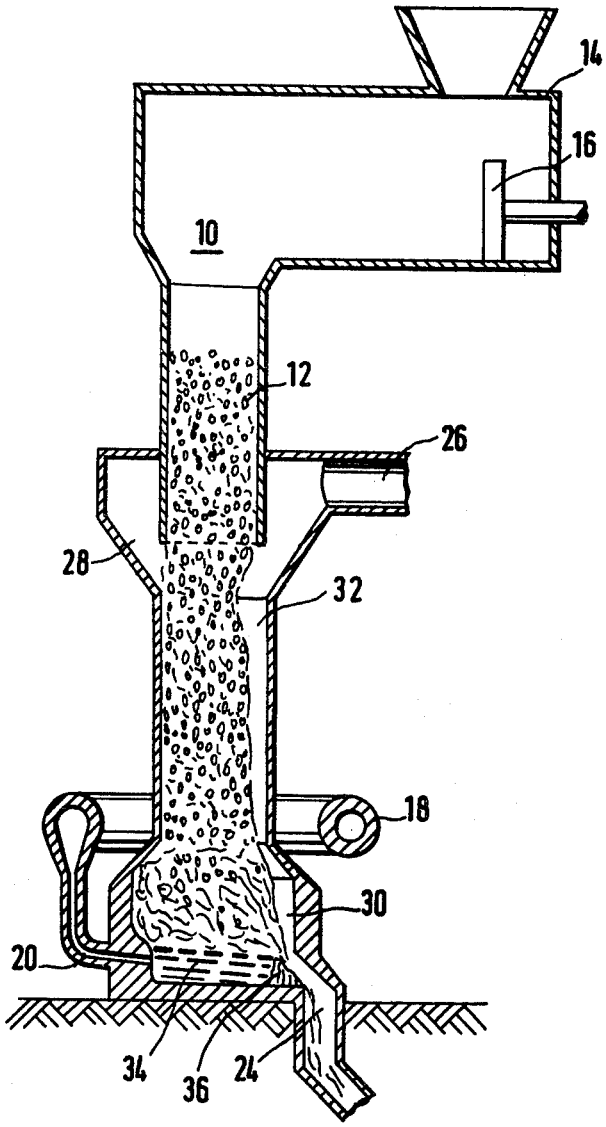
14
16
10
12
26
28
32
18
30
20
34
36
24

METHOD OF OPERATION FOR A REFUSE INCINERATING FURNACE

BACKGROUND OF THE INVENTION

The invention herein concerns a method of operation of a furnace for incinerating refuse, notably household refuse, commercial and industrial waste; this furnace comprised of a charging device for entering the waste into the upper part of a drying zone; this drying zone sits above a pyrolysis zone which in turn is above a combustion and melting zone, with a minimum of one orifice for removal of the volatile matter at the level of the drying zone and at least one orifice for the removal of the melted matter from the combustion and melting zone, with also one or more tuyeres to inject under pressure heated air with or without additional oxygen or pure oxygen into the combustion and melting zone.

A furnace of this type called simply "pyrolysis furnace" is described in German Offenlegungaschrift No. 2233498. Pyrolysis is a process of irreversable change produced by the action of heat in an environment deficient of oxygen. The pyrolysis zone of this type of furnace produces a distillation of the volatile fraction of the organic materials contained in the refuse fed into the furnace. The products of this pyrolysis are oxidized or melted in the lower combustion and melting zone and extracted as a liquid slag which is taken out of the furnace as a solid or granulate.

One particular problem of this type of furnace is the realization of a descending column of waste which occupies to a controlled height in the furnace the total volume therein and which can be renewed to the degree, by the feeding device above to which it is compacted, by drying and gasification in which it is consumed below. The method of attaining this condition is very difficult to realize and there forms very often a channel within the column of refuse, directly connecting combustion zone with the orifice for removal of the volatile products and short circuiting also the pyrolysis zone.

Experience has shown that it is very difficult to suppress a channel once it is formed. In effect even if the channel closes upon itself by the shifting of the refuse around it, or by the falling of refuse from higher levels in the channel, it will not disappear completely and the sort of plug formed in this way will not exist long prior to being consumed by the combustion products and oxygen emanating from the combustion.

As long as this channel exists, the majority of gases moving, ascend through it and the uniform distribution of the gases through all the volume of the furnace, indispensable to the proper operation of the process is far from guaranteed. It is given further that these channels generally form along the periphery of the furnace, the walls of which are exposed to higher temperatures than those intended for normal operation because of prolonged combustion in this channel, raising the risk of premature destruction of these walls by the elevated temperatures.

SUMMARY OF THE INVENTION

The aim of the invention herein is to provide a means of operation for a refuse incinerating furnace of the type described in the preface, which avoids the formation of channels and allows it to get, at both the level of the extraction of the slag, as at the level of the extraction of the volatile products, production of optimal quality.

To attain this objective, the method of the invention herein is essentially characterized in that it, at the level of the combustion and the dampening and controlling of melting zone, the energy liberated by the injection of gases under pressure is accomplished by injecting these gases into the mass of liquid slag.

The invention rests on a claim of the applicant that the formation of channels is engendered at the level of the tuyeres by localized combustion and intensely provoked by the pressurized jet of combustion gases and the energy dissipated by detaining these gases. This local combustion being fed by the injection of the gases under pressure, rapidly propagates wearing a path towards the upper levels. Once a channel is formed in this way, it is propagated in an uncontrollable manner and becomes the situation described above.

Thus, the merit of the invention is exercising a certain control upon the zone of combustion in suppressing conditions favorable to the birth and creation of a channel.

Conforming to the primary mode of operation, the flow of slag is slowed so that its surface passes the level of the tuyeres and the combustion gases begin to be injected into the mass of liquid slag.

Following the second mode of operation, the tuyeres are arranged obliquely and the stream of combustion gases is directed towards the liquid mass of slag in order to penetrate it.

By the fact of sending combustion gases into the mass of liquid slag, the action and energy of these gases is dissipated, which creates two essential and favorable consequences. At first combustion becomes uniform and regular throughout this zone and areas of intense localized combustion are avoided. The consequences of this is uniform distribution of the gases throughout the area of the solid column of refuse. Further, the gases entering this column have lost their concentrated mechanical energy and can't again cause a violent local reaction. Another favorable consequence is the mechanical action of the bubbling of the slag against the column of solid refuse, provoking a relative movement between the diverse solid components which open permanently, new passages for these gases inhibiting thereby the formation of channels. High speed injection of gases into the mass of liquified slag provoking a boiling of energy and influence favoring the properties of slag and oxidizing the remainders of carbon and metals which might still remain.

A simple way to form a pool of liquid slag having sufficient height to surpass the level of the tuyeres is by regulating the flow of slag for example by forming a small dam upstream of the orifice of slag flow. Such a dam could be formed by careful cooling of this orifice.

The invention will be more clearly understood after reading the detailed description given beneath with references keyed to the attached drawing showing a schematic view in partial section of a furnace for incineration of refuse.

BRIEF DESCRIPTION OF THE DRAWING

The drawing represents a vertical, sectional view of a Pyrolysis Furnace employing the concepts of the present invention.

DETAILED DESCRIPTION OF THE ILLUSTRATED EMBODIMENT

This drawing schematically shows the general view of Pyrolysis Furnace (10) for incineration of refuse (12) which is introduced into the furnace with the aid of an apparatus for charging (14) comprised notably of a sliding piston (16) to push the rubbish into the furnace (10). Combustion within the furnace (10) is kept up; the combustion air injected by the many tuyeres (20) connected to a circular feed duct (18). The liquid residues of combustion are removed in the form of a liquid slag at high temperature across an opening and a drain spout (24) situated at the bottom of the furnace. Pyrolysis gases are captured in the upper region of the furnace in a collector (28) and evaculated across a duct (26) to equipment for treatment and recuperation of this energy.

The lower part of the furnace (10) in the instance shown, is larger and constitutes the crucible (30). Within this crucible (30) is situated the combustion zone in which the residues of pyrolysis are oxidized or liquified.

Between this zone of combustion and the collector (28) is situated the pyrolysis zone. The drying zone sits above the pyrolysis at the level of the collector (28). A channel (32) is schematically represented between the wall of the furnace (10) and the refuse column (12), and extends from the combustion zone into the drying zone. This channel (32) disturbs the operation of the furnace (10) and short circuits the pyrolysis, which by this action not occurring, further adds to the risk of overheating the wall of the furnace (10). As mentioned above, the applicant has established that this channel is formed most often within the combustion zone with the combined action of the intense local combustion by injection under pressure of combustion gases. In effect it must be accounted that by the fact of injecting combustion gases by the tuyeres and in avoiding the plugging of the tuyeres with slag that the pressure of the gases are clearly higher than those found in the combustion zone. This condition implies a certain amount of mechanical energy freed into the combustion zone.

To greatly diminish the conditions favorable to the birth of a channel, the invention herein suggests the injection of combustion gases into the volume of liquid slag (34). This permits dissipation of the mechanical energy of the combustion gases within the mass of liquid slag (34). Combustion maintained by the bubbling of the mass (34).

A dam (36) is schematically represented as being formed by cooled slag assuring sufficient height to the slag pool (34). It is evident that other methods of providing a slag pool (34) or sufficient height are possible.

For example, it is possible to provide a discontinuous flow of slag; after a certain time slag flow would be stopped by means of a cooled plug placed into the flow aperature. To recommence the flow, the plug is removed and if necessary, the hole opens by a drill, a bar or an oxygen lance. By means of a cooled or uncooled cap of adjustable height, the level of the slag pool could easily be regulated.

Another solution for injecting the combustion gas into the slag (34) is to arrange the tuyeres (20) at a certain height discharging them on to the surface of the slag but at an angle and in a manner that the combustion gas is injected within the mass of slag (34). The effect and results of this variation resemble those described above. The merit of these solutions proposed to avoid the formation of channels is much greater than any other which have been known and used prior. The knowledge that the combustion gases should be injected into the surface and not onto the surface or simply into the furnace. Nevertheless, the proof exists that in experimental operation, the process proposed has had excellent results with not only an absence of channels but, equally, an improvement in the degree of purity of the slag and granulate produced.

We claim:

1. In a method of operating a pyrolysis furnace of the descending column type for incinerating refuse, notably household refuse, commercial and industrial rubbish, of the type comprising a charging zone, a drying zone, a pyrolysis zone and a combustion and melting zone, having at least one orifice for extracting volatile products from the drying zone, at least one orifice for extracting melted slag from the combustion and melting zone, and one or more tuyeres for injecting combustion gases under pressure into the combustion and melting zone, the improvement comprising injecting the combustion gases into the liquid mass of molten slag thereby controlling and diminishing the energy liberated at the level of the combustion and melting zone by the injection of said gases under pressure so as to prevent channel formation.

2. The method as set forth in claim 1 including regulating the rate of flow of the liquid mass of molten slag to a sufficiently slow rate such that the surface level of said slag rises above the level of said tuyeres thereby causing the combustion gases to be injected directly into the liquid slag.

3. The method as set forth in claim 2 wherein the regulating of the rate of flow of the liquid mass of molten slag is accomplished by cooling the melted slag upstream from the slag extracting orifice causing the formation of a dam of hardened slag which diminishes the rate of slag flow out of the orifice.

4. The method as set forth in claims 2 or 3 wherein the regulating of the rate of flow of the liquid mass of molten slag is accomplished by causing said slag to flow in a discontinuous manner.

5. The method as set forth in claim 1 including arranging the inclination of said tuyeres to a certain height and position within said furnace such that the combustion gases will be discharged obliquely onto the surface of the liquid mass of molten slag thereby causing said gases under pressure to penetrate said surface and enter into the liquid mass of molten slag.

* * * * *